US009180683B2

(12) United States Patent
Kawaguchi

(10) Patent No.: US 9,180,683 B2
(45) Date of Patent: Nov. 10, 2015

(54) DECOLORING DEVICE

(71) Applicants: KABUSHIKI KAISHA TOSHIBA, Tokyo (JP); TOSHIBA TEC KABUSHIKI KAISHA, Tokyo (JP)

(72) Inventor: Takahiro Kawaguchi, Mishima Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/631,704

(22) Filed: Feb. 25, 2015

(65) Prior Publication Data

US 2015/0251439 A1 Sep. 10, 2015

(30) Foreign Application Priority Data

Mar. 6, 2014 (JP) ..... 2014-044378

(51) Int. Cl.
*B41J 29/16* (2006.01)
*B41J 2/335* (2006.01)

(52) U.S. Cl.
CPC ..... *B41J 2/335* (2013.01)

(58) Field of Classification Search
USPC ..... 347/171, 179; 399/167, 328
See application file for complete search history.

(56) References Cited

U.S. PATENT DOCUMENTS

| | | | | |
|---|---|---|---|---|
| 7,324,237 | B2 * | 1/2008 | Okada | 347/179 |
| 8,284,221 | B2 | 10/2012 | Taguchi | |
| 8,717,618 | B2 | 5/2014 | Iguchi et al. | |
| 8,878,884 | B2 | 11/2014 | Kawaguchi et al. | |
| 2010/0315475 | A1 * | 12/2010 | Taki et al. | 347/179 |
| 2011/0065056 | A1 | 3/2011 | Iguchi et al. | |
| 2012/0038732 | A1 * | 2/2012 | Iguchi et al. | 347/179 |

* cited by examiner

*Primary Examiner* — Kristal Feggins
(74) *Attorney, Agent, or Firm* — Patterson & Sheridan, LLP

(57) ABSTRACT

According to embodiments, a decoloring device includes a heat source unit which decolors images printed on sheets. The heat source unit includes a first heat roller and a first press roller which decolor an image on a first surface of a sheet. The heat source unit further includes a second heat roller and a second press roller which decolor an image on a second surface of the sheet. When the sheet is a non-decolor processing target sheet, the first heat roller and the first press roller, and the second heat roller and the second press roller move away from each other.

14 Claims, 10 Drawing Sheets

DECOLORING DEVICE

CROSS-REFERENCE TO RELATED APPLICATION

This application is based upon and claims the benefit of priority from the prior Japanese Patent Application No. 2014-044378, filed on Mar. 6, 2014, the entire contents of which are incorporated herein by reference.

FIELD

Embodiments described herein generally relate to a decoloring device which includes a heat source unit which decolors images.

BACKGROUND

Conventionally, an image forming apparatus which prints images on sheets using toner is put into practical use by an electrophotography. The image forming apparatus includes a heat source unit which heats toner for forming an image, and fixes the image to a sheet by pressurizing the sheet. The heat source unit includes heat rollers, press rollers and the like. The heat source unit heats and pressurizes toner of the image formed on the sheet by conveying the sheet sandwiching the sheet between the heat rollers and the press rollers. A method of, when heating and pressurizing toner, conveying sheets without depositing the melting toner on sheets in the heat source unit of the image forming apparatus is adopted.

Meanwhile, a decoloring device which decolors an image printed on a sheet by the image forming apparatus is being proposed. The decoloring device includes a heat source unit including heat rollers and press rollers similar to, for example, the image forming apparatus. The decoloring device requires a higher amount of heat than that of the image forming apparatus to decolor an image formed on a sheet whose images are repeatedly decolored a plurality of times. The heat source unit of the decoloring device needs to maintain high surface temperatures of the heat rollers to secure the heat amount required for decoloring. By keeping higher temperatures of the heat rollers, the decoloring device can reliably decolor images from sheets whose images are repeatedly decolored a plurality of times. However, when, for example, a sheet on which an image is printed using toner which can be fixed at a lower temperature than a normal temperature passes through the heat source unit of the decoloring device, toner on a sheet surface melts and is offset on surfaces of the heat roller or the press roller. When the melting toner is offset on the heat rollers or the press rollers, the toner is offset from the rollers to a surface of a sheet which passes next through the heat source unit and makes the sheet surface dirty in some cases.

DETAILED DESCRIPTION

Figure 1:
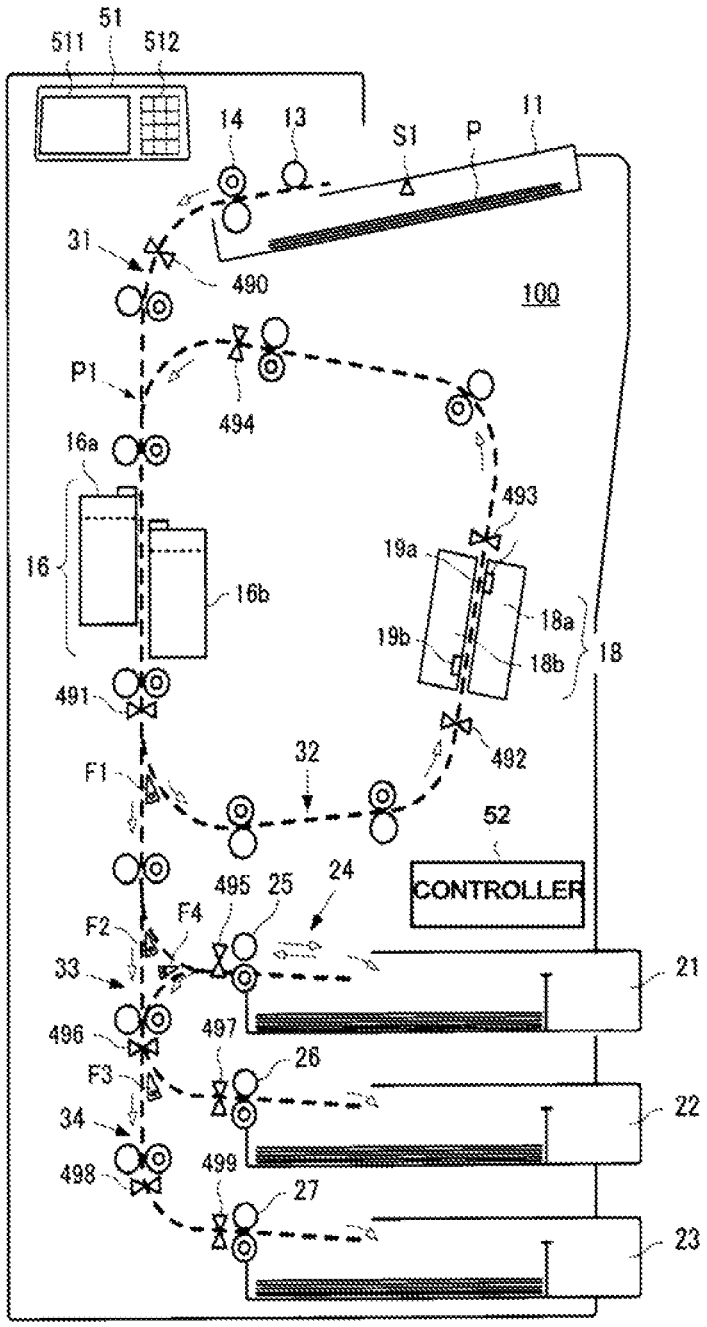
FIG. 1 is a cross-sectional view illustrating main parts of a decoloring device according to a first embodiment.

According to one embodiment, a decoloring device includes a reading unit, a first heat roller, a first press roller, a second heat roller, a second press roller and a controller. The reading unit reads images on surfaces of a sheet to be conveyed. The first heat roller is provided on a first surface side of the sheet, and heats the sheet from the first surface side of the sheet to perform decolor processing on the image printed on a first surface of the sheet. The first press roller is provided to oppose to the first heat roller. The first press roller rotates in contact with the first heat roller by being pressurized in a direction of the first heat roller from a second surface side of the sheet when the decolor processing is performed on the image printed on the first surface of the sheet, and conveys the sheet along with the first heat roller. The second heat roller is provided closer to a downstream side in a conveying direction of the sheet than the first press roller and on the second surface side of the sheet. The second heat roller heats the sheet from the second surface side of the sheet to perform the decolor processing on the image printed on a second surface of the sheet. The second press roller is provided to oppose to the second heat roller. The second press roller rotates in contact with the second heat roller by being pressurized in a direction of the second heat roller from the first surface side of the sheet when the decolor processing is performed on the image printed on the second surface of the sheet, and conveys the sheet along with the second heat roller. When determining that the sheet is a non-decolor processing target sheet based on a reading result of the reading unit, the controller moves the first heat roller and the first press roller away from each other, and moves the second heat roller and the second press roller away from each other.

Hereinafter, embodiments will be further described with reference to the drawings. In the drawings, the same reference numerals indicate the same or similar portions.

The first embodiment will be described with reference to FIG. 1. FIG. 1 is a cross-sectional view illustrating main parts of a decoloring device according to the first embodiment.

The decoloring device 100 performs decolor processing of erasing colors of an image from a sheet P on which the image is printed by a decolorable color material such as decolorable toner or a decolorable ink. The decolorable color material includes a coloring compound, a developer and a decoloring agent. The coloring compound is, for example, leuco dye. The developer is, for example, phenol. The decoloring agent is a substance which becomes compatible with the coloring compound when heated, and does not have an affinity with the developer. The decolorable color material develops a color based on an interaction between the coloring compound and the developer. When the decolorable color material reaches a predetermined decoloring temperature or more, the interaction between the coloring compound and the developer stops and a color is decolored. The decoloring color material includes a decoloring temperature unique to a type of the decoloring color material. The decoloring device 100 targets at a decolorable color material of a predetermined decoloring temperature as a decolor processing target. A decolorable color material which is a decolor processing target will be simply referred to as a "target decolorable color material" below. In addition, "decoloring a color" or "decoloring" in the present embodiment means making an image formed using colors (including not only chromatic colors but also achromatic colors such as white and black) different from sheet basic colors visually invisible or hardly visible for people.

As illustrated in FIG. 1, the decoloring device 100 includes a paper feed tray 11, paper feeding members 13 and 14, a reading unit 16, a heat source unit 18, a double-side reuse paper tray 21, a single-surface reuse paper tray 22, a reject paper tray 23, discharge rollers 25, 26 and 27, a first conveying path 31, a second conveying path 32, a third conveying path 33, a fourth conveying path 34, a first flapper F1, a second flapper F2, a third flapper F3, a fourth flapper F4 and a control panel 51. The first to fourth flappers F1 to F4 are rotatable in a clockwise direction or a counterclockwise direction, and control a conveying direction of the sheet P.

The paper feed tray 11 supports the sheets P set and reused by a user. The paper feed tray 11 supports the sheets P of various sizes such as A4, A3, B5. An image is printed on the sheet P using the decolorable color material. The sheet P to be reused is, in other words, a sheet whose printed images are decolored. The paper feeding member 13 includes, for example, a pick-up roller, and takes out the sheets P from the paper feed tray 11. The paper feeding member 14 includes, for example, a sheet feeding roller and a separating roller disposed to oppose to the sheet supply roller. The paper feeding member 14 separates the sheets P taken out by the paper feeding member 13 one by one, and feeds the sheets P to the first conveying path 31 inside the decoloring device 100.

The paper feed tray 11 further includes a sheet presence/absence sensor S1. The sheet presence/absence sensor S1 detects whether there are the sheets P on the paper feed tray 11. The sheet presence/absence sensor S1 may be, for example, a microsensor or a microactuator. The first conveying path 31 forms a conveying path which goes from the paper feed tray 11 to the double-side reuse paper tray 21. The first conveying path 31 conveys the sheets P fed by the paper feeding member 14, to the double-side reuse paper tray 21 via the reading unit 16.

The reading unit 16 is disposed at a sheet conveying direction position closer to a downstream than the paper feed tray 11, and along the first conveying path 31. The reading unit 16 includes a reading unit such as a Charge Coupled Device (CCD) scanner or a Complementary Metal Oxide Semiconductor (CMOS) sensor. By scanning a first surface (e.g. top surface) and a second surface (e.g. back surface) of the sheet P to be conveyed, the reading unit 16 reads images on the first and second surfaces. More specifically, the reading unit 16 includes a first reading unit 16*a* and a second reading unit 16*b*. The first reading unit 16*a* and the second reading unit 16*b* are disposed along the first conveying path 31 while sandwiching the first conveying path 31 to provide a positional relationship which makes it possible to read both surfaces of the sheets P to be conveyed.

The images read by the reading unit 16 are stored in a memory 522 (see FIG. 4) described later. For example, before performing decolor processing, the decoloring device 100 digitizes the images on the sheets P read by the reading unit 16, and stores data of the digitized images in the memory 522. Consequently, by reading image data from the memory 522, the decoloring device 100 can provide to the user an image which the user needs after decolor processing.

The decoloring device 100 further includes a controller 52 described later. The controller 52 determines whether or not the sheet P is a decolorable sheet based on data of the image of the sheet P before being subjected to decolor processing and which is read by the reading unit 16. The decolorable sheet is, for example, a sheet on which an image is printed using a target decolorable color material. The controller 52 determines whether the sheet P is a reusable sheet based on data of the read image of the sheet P before being subjected to decolor processing. More specifically, in order to determine whether the sheet P is a reusable sheet, the controller 52 determines whether or not the number of times of image decoloring of the sheet P reaches a predetermined value based on data of the read image of the sheet P which is not yet subjected to the decolor processing. Further, in order to determine whether the sheet P is a reusable sheet, the controller 52 determines whether or not a coverage rate of images of the sheet P is a predetermined coverage rate or more, based on the data of the read image of the sheet P before being subjected to decolor processing. The decoloring device 100 performs decolor processing on sheets which are determined as sheets which can be decolored and as reusable sheets before the decolor processing. The controller further determines whether an image is decolored based on data of the image of the sheet P before being subjected to the decolor processing and which is read by the reading unit 16. The sheet P which is determined as a sheet whose images are decolored from the both surfaces after the decolor processing will be referred to as a double-side reusable sheet. Further, the sheet P which is determined as a sheet whose image is decolored from one surface after the decolor processing will be referred to as a single-side reusable sheet. Furthermore, the sheet P which is determined as a sheet which is not decolorable or as a sheet which is not the reusable sheet before the decolor processing will be referred to as an unreusable sheet. Still further, the sheet P which is determined as a sheet whose images are not decolored from the both surfaces after the decolor processing will be also referred to as an unreusable sheet.

The second conveying path 32 is branched from the first conveying path 31 at a sheet conveying direction position closer to the downstream than the reading unit 16. The first flapper F1 is disposed at this branching position. The first flapper F1 switches the conveying direction of the sheets P to sort the sheets P conveyed on the first conveying path 31. The first flapper F1 guides the sheets P to the second conveying path 32 or the reuse paper tray 21 by switching the conveying direction of the sheets P. As described above, the second conveying path 32 is branched from the first conveying path 31 at a branching point at which the first flapper F1 is disposed. The second conveying path 32 which is branched from the branching point conveys the sheets P to the heat source unit 18 which is a decoloring unit which decolors images on the sheet P.

Further, the second conveying path 32 joins the first conveying path 31 at a sheet conveying direction joining position P1 closer to the upstream than the reading unit 16 and closer to the downstream than the paper feed tray 11. In other words, the second conveying path 32 forms a conveying path which goes from the branching point at which the first flapper F1 is disposed, to the joining position P1 via the heat source unit 18. Hence, the second conveying path 32 conveys the sheets P conveyed from the reading unit 16, to the reading unit 16 again via the heat source unit 18. More specifically, the decoloring device 100 conveys the sheet P fed from the paper feed tray 11 to the reading unit 16, the heat source unit 19 and the reading unit 16 in order by controlling the first flapper F1.

The first conveying path 31 includes the second flapper F2. More specifically, the second flapper F2 is disposed along the first conveying path 31 and at a sheet conveying direction position closer to the downstream than the first flapper F1. The second flapper F2 guides the sheet P guided by the first flapper F1, to the double-side reuse paper tray 21 or the third conveying path 33. The third conveying path 33 forms a conveying path which goes from the position at which the second flapper F2 is disposed, to the single-side reuse paper tray 22. The third conveying path 33 conveys the sheet P to the single-side reuse paper tray 22.

The third conveying path 33 includes the third flapper F3. More specifically, the third flapper F3 is disposed along the third conveying path 33 and at a sheet conveying direction position closer to the downstream than the second flapper F2. The third flapper F3 guides the sheet P guided by the second flapper F2, to the single-side reuse paper tray 22 or the fourth conveying path 34. The fourth conveying path 34 forms a conveying path which goes from the position at which the third flapper F3 is disposed, to the reject paper tray 23. The fourth conveying path 34 conveys the sheet P to the reject paper tray 23. The fourth flapper F4 is disposed along the first conveying path 31 and between the second flapper F2 and the discharge roller 25. The fourth flapper F4 guides the sheet P guided by the second flapper F2, to the discharge roller 25. Further, the fourth flapper F4 guides to the third conveying path 33 the sheet P which is switched back when a sheet surface is reversed as described later.

The heat source unit 18 decolors an image which is printed using the target decolorable color material on the sheet P to be conveyed. The heat source unit 18 heats the sheet P in a state where the heat source unit 18 is in contact with the sheet P which is being conveyed, such that the decolorable color material of the image reaches a setting temperature to decolor the image printed on the sheet P. The heat source unit 18 decolors the image printed on the sheet P using the target decolorable color material by heating the sheet P as described above. The heat source unit 18 of the decoloring device 100 includes a first decoloring unit 18*a* which decolors an image on a first surface of the sheet P, and a second decoloring unit 18*b* which decolors an image on a second surface. The first decoloring unit 18*a* and the second decoloring unit 18*b* are disposed to oppose to each other across the second conveying path 32. The setting temperature is, for example, a decoloring temperature of the target decolorable color material.

The first decoloring unit 18*a* contacts the first surface of the sheet P and heats the sheet P. The second decoloring unit 18*b* contacts the second surface of the sheet P and heats the sheet P. The heat source unit 18 causes the first decoloring unit 18*a* and the second decoloring unit 18*b* to decolor images on the both surfaces of the sheet P at a time when the sheet P is conveyed. Positions at which the first decoloring unit 18*a* and the second decoloring unit 18*b* heat the sheet P are decoloring positions at which images are decolored. The heat source unit includes temperature sensors 19*a* and 19*b*. The temperature sensor 19*a* detects a temperature of a first heat roller 18*a*1 of the first decoloring unit 18*a* described later. The temperature sensor 19*b* detects a temperature of a second heat roller 18*b*1 of the second decoloring unit 18*b* described later. The temperature sensors 19*a* and 19*b* may be contact sensors, or may be non-contact sensors.

The control panel 51 is disposed at a top portion of a main body of the decoloring device 100. The control panel 51 includes a touch panel type display unit 511 and various operation keys 512. The operation keys 512 are, for example, a numeric keypad, a stop key and a start key. The control panel 51 receives a user's instruction to start processing, selection of a function, a setting of processing conditions and the like through the operation keys 512. When, for example, the control panel 51 receives the user's instruction to start decolor processing, the decoloring device 100 starts the decolor processing. When, for example, the control panel 51 receives user's selection of a function of performing reading processing, the decoloring device 100 reads images of the sheet P before the decolor processing, and stores image data as described above. The display unit 511 displays setting information, an operation status or log information of the decoloring device 100 or a message to the user.

The discharge roller 25 discharges the sheet P to the double-side reuse paper tray 21. The discharge roller 26 discharges the sheet P to the single-side reuse paper tray 22. The discharge roller 27 discharges the sheet P to the reject paper tray 23. The double-side reuse paper tray 21, the single-side reuse paper tray 22 and the reject paper tray 23 are detachably disposed at a lower portion of the main body of the decoloring device 100. The double-side reuse paper tray 21 stocks the sheets P which are determined as the double-side reusable sheets. The single-side reuse paper tray 22 stocks the sheets P which are determined as the single-side reuse sheets. The reject paper tray 23 stocks the sheets P which are determined as the unreusable sheets. The decoloring device 100 includes a printing device which is not illustrated. The decoloring device 100 cause the printing device to print a mark indicating unreusable to an unreusable surface of a single-side reusable sheet. The decoloring device 100 can notify the unreusable surface of the single-side reusable sheet to the user by printing the mark on the sheet. For the printing device, for example, a printing device of an ink-jet printer type is used.

The discharge roller 25 discharges double-side reusable sheets to the double-side reuse paper tray 21 as described above to stock the double-side reusable sheets on the double-side reuse paper tray 21. Further, the discharge roller 25 also functions as a sheet reversing mechanism 24. The sheet reversing mechanism 24 reverses a sheet surface by switching back the sheet once before the sheet is stocked such that the single-side reusable sheets are stocked on the single-side reuse paper tray 22 with reusable surfaces directed in one direction.

A case where, for example, the single-side reusable sheets are stocked on the single-side reuse paper tray 22 with reusable surfaces directed upward in FIG. 1 will be described. When the single-side reusable sheets are stocked on the single-side reuse paper tray 22 from the first conveying path 31 directly via the third conveying path 33, the decoloring device 100 determines whether reusable surfaces of the single-side reusable sheets are directed upward or downward in FIG. 1. When the decoloring device 100 determines that the reusable surfaces are directed downward, the second flapper F2 and the fourth flapper F4 guide the single-side reusable sheets conveyed from the first conveying path 31, to the discharge roller 25. The discharge roller 25 conveys the single-side reusable sheets to a direction of the double-side reuse paper tray 21 until a rear end of the single-side reusable sheet guided by the second flapper F2 and the fourth flapper F4 passes through the fourth flapper F4. When the rear end of the single-side reusable sheet passes through the fourth flapper F4, the discharge roller 25 stops once, then rotates in a reverse direction, and conveys the single-side reusable sheets to a direction opposite to the double-side paper tray 21. The fourth flapper F4 guides the single-side reusable sheets switched back by the discharge roller 25, to the third conveying path 33. The third conveying path 33 conveys the single-side reusable sheets switched back and guided by the fourth flapper F4. The third flapper F3 guides the single-side reusable sheets conveyed by the third conveying path 33, to the discharge roller 26. The discharge roller 26 discharges the single-side reusable sheets to the single-side reuse paper tray 22. Hence, the single-reusable sheets are stocked on the single reuse tray 22 from the first conveying path 31 directly via the third conveying path 33 in some cases, and are conveyed to the double-side reuse paper tray 21 once and stocked on the single-side reuse paper tray 22 after sheet surfaces are reversed. The decoloring device 100 stocks the single-side reusable sheets on the single-side reuse paper tray 22 in a state where, for example, reusable surfaces are directed upward in FIG. 1 by reversing the sheet surfaces as described above.

The double-side reuse paper tray 21, the single-side reuse paper tray 22 and the reject paper tray 23 can also switch between types of stock target sheets (double-side reusable sheets, single-side reusable sheets and unreusable sheets). More specifically, the control panel 51 receives a user's setting as to which type of sheets to stock on each of the trays 21 to 23. In other words, the control panel 51 receives a user's setting as to a conveying destination of the sheets P. The decoloring device 100 stocks double-side reusable sheets, single-side reusable sheets and unreusable sheets on the trays 21 to 23 according to the user's setting received by the control panel 51.

More specifically, according to the user's setting received by the control panel 51, the second flapper F2 switches a conveying path, and guides conveyed sheets to the double-side reuse paper tray 21 or the third conveying path 33. Further, the third flapper F3 switches a conveying path, and guides conveyed sheets to the single-side reuse paper tray 22 or the fourth conveying path 34.

As illustrated in FIG. 1, the decoloring device 100 includes a plurality of sheet position sensors 490 to 499. The sheet position sensors 490 to 499 detect a position of the sheet P conveyed on the first to fourth conveying paths 31 to 34. The sheet position sensors 490 to 499 include, for example, microsensors or microactuators. The sheet position sensors 490 to 499 are disposed at adequate positions along the first to fourth conveying paths 31 to 34.

Figure 2:
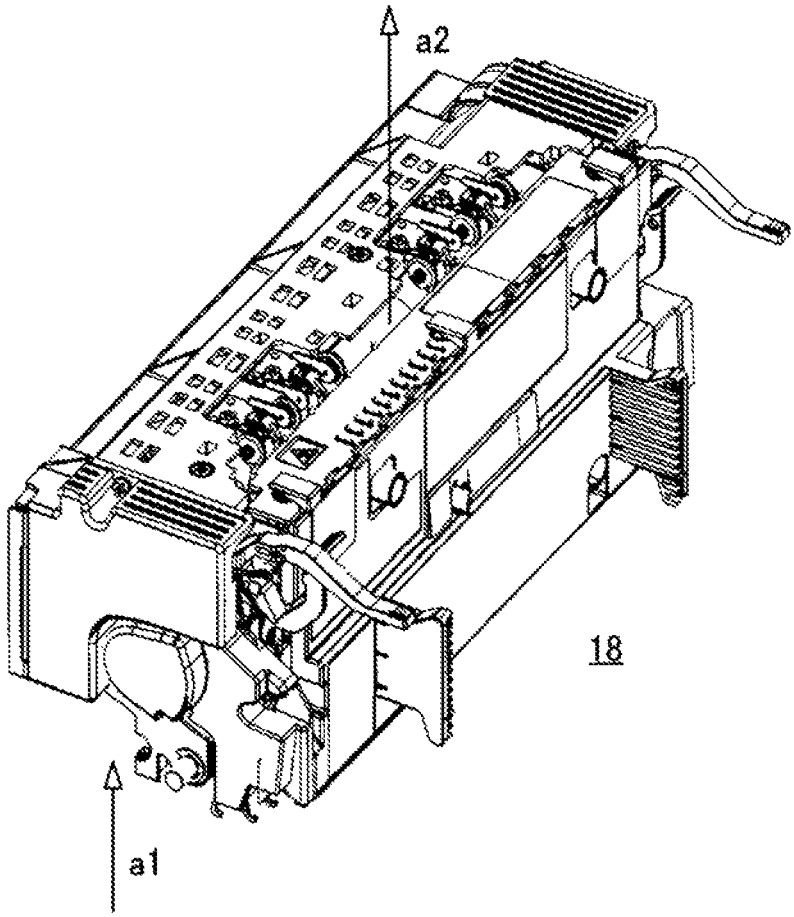
FIG. 2 is a perspective view illustrating a heat source unit of the decoloring device according to the first embodiment.

The heat source unit 18 will be described in detail with reference to FIGS. 2 and 3. FIG. 2 is a perspective view illustrating the heat source unit. The heat source unit 18 conveys the sheet P on which an image is printed using a decolorable color material, from the below as indicated by an arrow a1 in FIG. 2 to the above as indicated by an arrow a2 while heating the sheet P, and decolors the image of the sheet P in this conveying process.

Figure 3:
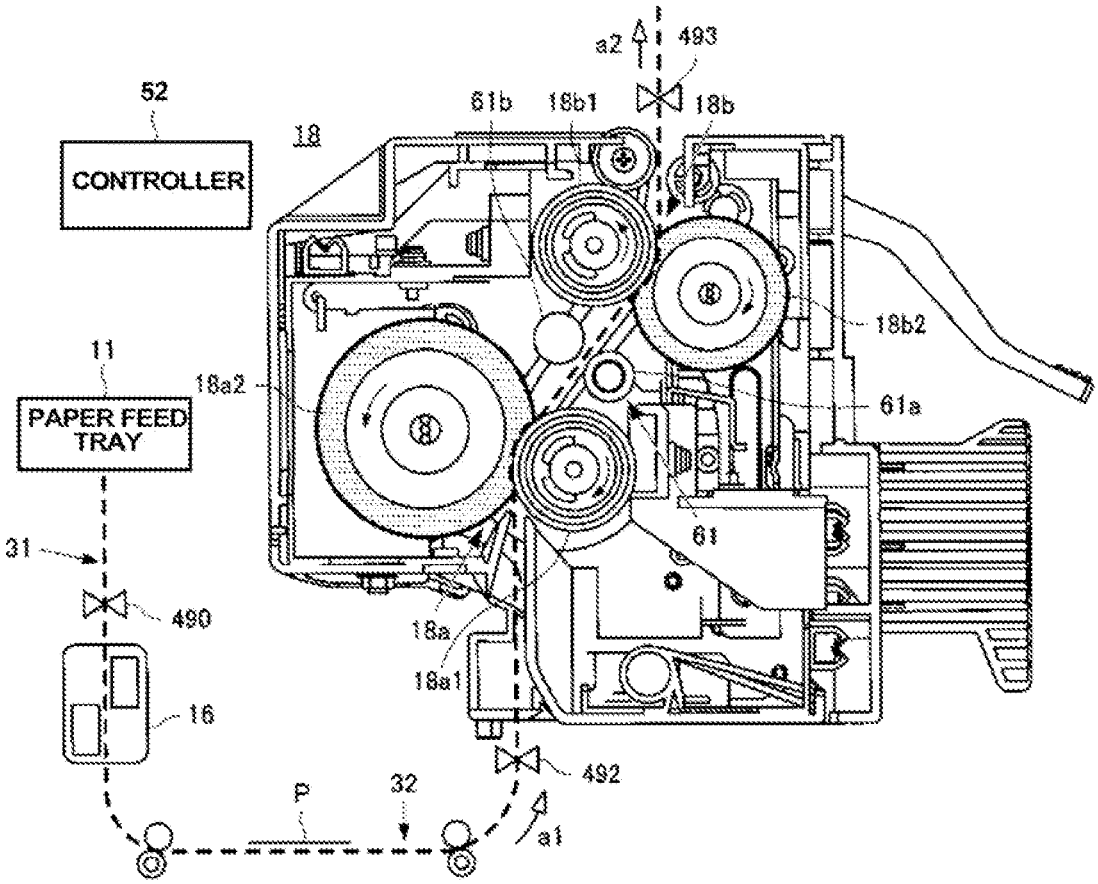
FIG. 3 is a cross-sectional view illustrating the heat source unit of the decoloring device according to the first embodiment.

FIG. 3 is a cross-sectional view illustrating the heat source unit 18. The heat source unit 18 includes the first and second decoloring units 18*a* and 18*b* as described above.

As illustrated in FIG. 3, the first decoloring unit 18*a* includes the first heat roller 18*a*1 and a first press roller 18*a*2. The first heat roller 18*a*1 is provided along the second conveying path 32 and on a first surface side of the sheet P. The first heat roller 18*a*1 is a movable roller which rotates by receiving a driving force transmitted from a motor which is not illustrated. The first press roller 18*a*2 is provided to oppose to the first heat roller 18*a*1. The first press roller 18*a*2 is a driven roller which is driven by the first heat roller 18*a*1 to rotate while being placed in contact with the first heat roller 18*a*1 by being pressurized from a second surface side of the sheet P to a direction of the first hear roller 18*a*1. As illustrated in FIG. 3, the second decoloring unit 18*b* includes a second heat roller 18*b*1 and a second press roller 18*b*2. The second heat roller 18*b*1 and the second press roller 18*b*2 are disposed at positions closer to the downstream in the sheet conveying direction than the first heat roller 18*a*1 and the first press roller 18*a*2. The second heat roller 18*b*1 is provided along the second conveying path 32 and on the first surface side of the sheet P. The second heat roller 18*b*1 is a movable roller which rotates by receiving a driving force transmitted from the motor which is not illustrated. The second press roller 18*b*2 is provided to oppose to the second heat roller 18*b*1. The second press roller 18*b*2 is a driven roller which is driven by the second heat roller 18*b*1 to rotate while being placed in contact with the second heat roller 18*b*1 by being pressurized from the first surface side of the sheet P to a direction of the second hear roller 18*b*1.

The first heat roller 18*a*1 and the second heat roller 18*b*1 each include a heat source which heats the sheet P to decolor an image printed on the sheet P. For the heat source, for example, an Induction Heating (IH) or a lamp is used. The first heat roller 18*a*1 heats the sheet P at a heating temperature t1 such that a decolorable color material of an image printed on the first surface of the sheet P reaches the setting temperature. The second heat roller 18*b*1 heats the sheet P at a heating temperature t2 such that a decolorable color material of an image printed on the second surface of the sheet P reaches the setting temperature. A relationship between the heating temperature t1 of the first heat roller 18*a*1 with respect to the sheet P and the heating temperature t2 of the second heat roller 18*b*1 with respect to the sheet P is t1>t2. Since the sheet P before being subjected to heating is conveyed to the first heat roller 18*a*1, the heating temperature of the first heat roller 18*a*1 with respect to the sheet P lowers. Hence, taking into account that the heating temperature of the first heat roller 18*a*1 lowers, the heating temperature t1 is set to a predetermined temperature higher than the heating temperature t2. By contrast with this, since the sheet P heated by the first heat roller 18*a*1 is conveyed to the second heat roller 18*b*1, the heating temperature of the second heat roller 18*b*1 with respect to the sheet P rises. Hence, the heating temperature t2 is set to a predetermined temperature lower than the heating temperature t1 such that the heating temperature of the second heat roller 18*b*1 with respect to the sheet P does not rise more than necessary.

Further, the first heat roller 18*a*1 and the second heat roller 18*b*1 are rollers having the same diameters. By contrast with this, the first press roller 18*a*2 is a roller having a larger diameter than that of the second press roller 18*b*2. In other words, a contact area of the first heat roller 18*a*1 and the first press roller 18*a*2 is wider than a contact area of the second heat roller 18*b*1 and the second press roller 18*b*2. Hence, a contact area of the first heat roller 18*a*1 and the sheet P is wider than a contact area of the second heat roller 18*b*1 and the sheet P, and a contact time of the first heat roller 18*a*1 and the sheet P is longer than a contact time of the second heat roller 18*b*1 and the sheet P. Hence, the heating time of the first heat roller 18*a*1 with respect to the sheet P is longer than the heating time of the second heat roller 18*b*1 with respect to the sheet P. By increasing the heating time with respect to the sheet P, it is possible to improve a rise in the heating time with respect to the sheet P. Sizes of diameters of the first press roller 18*a*2 and the second press roller 18*b*2 are selected such that the heating times with respect to the sheet P becomes an adequate time. The heating temperature t1 and the heating temperature t2 are set to the predetermined temperatures taking into account the heating time with respect to the sheet P, too.

The first press roller 18*a*2 is provided such that the first press roller 18*a*2 can be displaced by a contact/separate mechanism which is not illustrated between a first position at which the first press roller 18*a*2 moves away from the first heat roller 18*a*1 and a second position at which the first press roller 18*a*2 can be driven to rotate in pressure contact with the first heat roller 18*a*1. Further, the second press roller 18*b*2 is provided such that the second press roller 18*b*2 can be displaced by the contact/separate mechanism which is not illustrated between a first position at which the second press roller 18*b*2 moves away from the second heat roller 18*b*1 and a second position at which the second press roller 18*b*2 can be driven to rotate in pressure contact with the second heat roller 18*b*1. The first position is a position at which the first heat roller 18*a*1 and the first press roller 18*a*2, and the second heat roller 18*b*1 and the second press roller 18*b*2 do not contact the surface of the sheet P. The second position is a position at which the first heat roller 18*a*1 and the first press roller 18*a*2, and the second heat roller 18*b*1 and the second press roller 18*b*2 contact the surface of the sheet P. The first press roller 18*a*2 and the second press roller 18*b*2 are displaced to the second positions upon heating operations performed by the first and second decoloring units 18*a* and 18*b* for decolor processing. Hence, the first heat roller 18*a*1 and the first press roller 18*a*2, and the second heat roller 18*b*1 and the second press roller 18*b*2 contact the surface of the sheet P. FIG. 3 illustrates that the first press roller 18*a*2 and the second press roller 18*b*2 are displaced to the second positions, and the first heat roller 18*a*1 and the first press roller 18*a*2, and the second heat roller 18*b*1 and the second press roller 18*b*2 contact the surface of the sheet P. The first press roller 18*a*2 and the second press roller 18*b*2 are displaced to the second positions upon non-decolor processing performed by the first and second decoloring units 18*a* and 18*b*. Hence, the first heat roller 18*a*1 and the first press roller 18*a*2, and the second heat roller 18*b*1 and the second press roller 18*b*2 move away from the sheet P.

Further, as illustrated in FIG. 3, the heat source unit 18 includes a sheet conveying roller 61. The sheet conveying roller 61 includes a movable roller 61*a* and a driven roller 61*b*. The movable roller 61*a* rotates when receiving a driving force transmitted from the motor which is not illustrated. The driven roller 61*b* is driven by the movable roller 61*a* to rotate in pressure contact with the movable roller 61*a*. The sheet conveying roller 61 is disposed between the first decoloring unit 18*a* and the second decoloring unit 18*b*. The movable roller 61*a* and the driven roller 61*b* are disposed sandwiching the second conveying path 32 which is indicated by a broken line in FIG. 3 and conveys the sheets P. The movable roller 61*a* and the driven roller 61*b* are provided such that the movable roller 61*a* and the driven roller 61*b* can be displaced by the contact/separate mechanism which is not illustrated between first positions at which the movable roller 61*a* and the driven roller 61*b* do not contact with each other and second positions at which the movable roller 61*a* and the driven roller 61*b* contact with each other. At the second positions, the movable roller 61*a* and the driven roller 61*b* can rotate sandwiching sheets. FIG. 3 illustrates the movable roller 61*a* and the driven roller 61*b* displaced to the first positions.

The movable roller 61*a* and the driven roller 61*b* of the sheet conveying roller 61 are displaced to the first positions upon the heating operations performed by the first and second decoloring units 18*a* and 18*b* for decolor processing (see FIG. 3). In other words, the movable roller 61*a* and the driven roller 61*b* move away from each other upon the heating operations performed by the first and second decoloring units 18*a* and 18*b* for decolor processing. The movable roller 61*a* and the driven roller 61*b* are displaced to the second positions upon non-decolor processing performed by the first and second decoloring units 18*a* and 18*b*. In other words, the movable roller 61*a* and the driven roller 61*b* contact with each other upon the non-decolor processing performed by the first and second decoloring units 18*a* and 18*b*. The movable roller 61*a* and the driven roller 61*b* contact with each other, and thereby sandwich and convey the sheets P.

Upon the heating operations performed by the first and second decoloring units 18*a* and 18*b* for decolor processing, the first heat roller 18*a*1 rotates in the clockwise direction in FIG. 3, and the first press roller 18*a*2 comes into pressure contact with the first heat roller 18*a*1 and is driven to rotate in the counterclockwise direction as illustrated in FIG. 3. Further, the second heat roller 18*b*1 rotates in the counterclockwise direction in FIG. 3, and the second press roller 18*b*2 comes into pressure contact with the second heat roller 18*b*1 and thereby is driven to rotate in the clockwise direction.

The controller 52 controls operations of the first and second decoloring units 18*a* and 18*b* of the heat source unit 18 and driving of the sheet conveying roller 61 based on a state of the sheet P which passes through the heat source unit 18.

Figure 4:
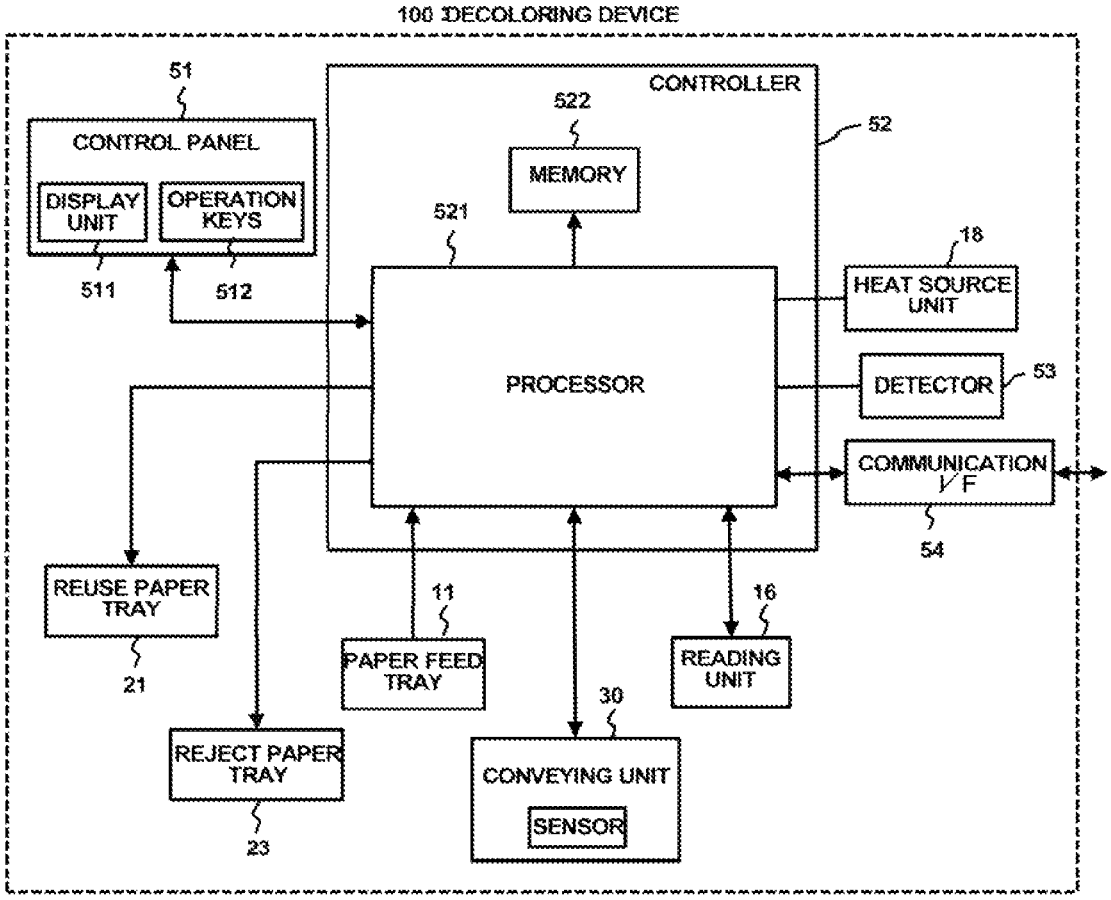
FIG. 4 is a block diagram illustrating a hardware configuration of the decoloring device according to the first embodiment.

A hardware configuration of the decoloring device 100 including the controller 52 will be described with reference to FIG. 4. FIG. 4 is a block diagram illustrating the hardware configuration of the decoloring device 100.

The decoloring device 100 includes the controller 52, a processor 521, the memory 522, a detector 53, a communication interface (referred to as a communication I/F) 54, a conveying unit 30, the reading unit 16, the heat source unit 18 and the control panel 51.

The controller 52 controls each component inside the decoloring device 100 based on signals from the detector 53. The detector 53 includes such as the sheet presence/absence sensor S1, the temperature sensors 19*a* and 19*b* and the sheet position sensors 490 to 499 illustrated in FIG. 1.

The controller 52 includes the processor 521 and the memory 522. The processor 521 includes a Central Processing Unit (CPU) or a Micro Processing Unit (MPU). The controller 52 controls the reading unit 16, the heat source unit 18, the control panel and the like. The memory 522 includes a Read Only Memory (ROM) and a Random Access Memory (RAM). The ROM of the memory 522 stores various types of control programs. The RAM of the memory 522 provides a temporary working area to the processor 521. Further, the ROM stores a predetermined coverage rate as a threshold for determining whether or not the sheet P is reusable. Furthermore, the ROM stores a predetermined gray level as a threshold for determining whether or not an image is decolored from the sheet P after being subjected to decolor processing. Still further, the RAM temporarily stores data of the image of the sheet P before being subjected to decolor processing and which is read by the reading unit 16. Each component of the decoloring device 100 illustrated in FIG. 4 is connected with each other through a bus.

The decoloring device 100 has a function of reading processing, decolor processing and sorting processing. The controller 52 controls the reading unit 16, the heat source unit and the other components according to user's selected processing, user's set conditions and the like received by the control panel 51.

Upon the reading processing, the controller 52 stores in the memory 522 data of images read by the reading unit 16 before the decolor processing. Upon the decolor processing, the controller 52 drives the heat source unit 18, and decolors an image printed on the sheet P using the decolorable color material.

Upon the sorting processing, the controller 52 determines whether or not the sheet P is a reusable sheet based on, for example, the data of the image read by the reading unit 16 before the decolor processing. The controller 52 determines whether or not there is an image which is not decolored on the sheet P based on, for example, the data of the image read by the reading unit 16 after the decolor processing. When determining that there is no image which is not decolored on both surfaces of the sheet P after being subjected to the decolor processing, the controller 52 determines that the sheet P after being subjected to the decolor processing as a double-side reusable sheet. When determining that there is not an image which is not decolored on the first surface of the sheet P after being subjected to the decolor processing and determining that there is an image which is not decolored on the second surface, the controller 52 determines that the sheet P after being subjected to the decolor processing is a single-side reusable sheet. Further, when determining that there are images which are not decolored on both surfaces of the sheet P after being subjected to the decolor processing, the controller 52 determines that the sheet P after being subjected to the decolor processing is an unreusable sheet.

As described above, the controller 52 controls each component inside the decoloring device 100 based on signals from the detector 53. In addition to the sheet presence/absence sensor S1, the temperature sensors 19*a* and 19*b* and the sheet position sensors 490 to 499, the detector 53 includes a sheet amount sensor and the like which are not illustrated. The sheet amount sensor detects the amount of the sheets P stocked on the reuse paper trays 21 and 22 and the reject paper tray 23. The controller 52 determines whether or not there is the sheet P on the paper feed tray 11 based on a signal from the sheet presence/absence sensor S1.

Further, the controller 52 detects temperatures of the first and second heat rollers 18*a*1 and 18*b*1 of the first and second decoloring units 18*a* and 18*b* using the temperature sensors 19*a* and 19*b*. The controller 52 controls the temperatures of the first and second heat rollers 18*a*1 and 18*b*1 based on a temperature detection result such that the temperatures of the first and second heat rollers 18*a*1 and 18*b*1 reach the heating temperatures t1 and t2. The controller 52 learns the position of the sheet P on the first to fourth conveying paths 31 to 34 using the sheet position sensors 490 to 499. For example, the controller 52 detects whether or not the sheet P is sent out from the paper feed tray 11 to the first conveying path 31 using the sheet position sensor 490. For example, the controller 52 detects the sheet P which passes through the reading unit 16 using the sheet position sensor 491 which is disposed closer to the downstream in the sheet conveying direction than the reading unit 16 and near the reading unit 16.

The memory 522 stores application programs and basic software as the various types of control programs. The application programs include programs which execute a function of reading processing performed by the reading unit 16 and a function of decolor processing performed by the heat source unit 18. The application programs further include a web client application (web browser) and other applications. Further, the memory 522 stores data of images read by the reading unit 16 as described above, and, in addition, stores, for example, the number of processed sheets P processed by the decoloring device 100. The decoloring device 100 may include a memory such as a hard disk drive or other magnetic storage devices, an optical storage device, a semiconductor storage device such as a flash memory or a combination of thereof in addition to the ROM and RAM.

The communication I/F 54 is an interface which connects to external devices. The communication I/F 54 communicates with an external device on a network by adequate radio such as IEEE802.15, IEEE802.11, IEEE802.3 and IEEE3304 of Bluetooth (registered trademark), infrared communication and optical communication or by cables. The communication I/F 54 may further include a USB connection portion to which a connection terminal based on the USB standards is connected, a parallel interface and the like.

The controller 52 communicates with an external device such as a Multi-Function Peripheral (MFP), a user terminal, a server or the like using the communication I/F 54. For example, the decoloring device 100 may store data of images read by the reading unit 16, in a storage device of an external device instead of storing the data in the memory 522 of the decoloring device 100. More specifically, the controller 52 transmits the data of the read image to the external device by communicating with the external device using the communication I/F 54. The external device stores the image data transmitted from the decoloring device 100, in the storage device of the external device. The image data stored in the storage device of the external device is read from the storage device of an MFP when, for example, a user's read instruction is received through an operation panel of the MFP.

The conveying unit 30 includes a plurality of conveying rollers disposed along the first to fourth conveying paths 31 to 34, and a conveying roller motor which drives the conveying rollers. The controller 52 controls a convey rate of the sheet P by controlling driving of the conveying roller motor of the conveying unit 30. The convey rate of the sheet P conveyed to the reading unit 16 to read the image of the sheet P is a read rate of the reading unit 16. The convey rate of the sheet P which is conveyed through the heat source unit 18 to decolor the image of the sheet P is a decolor rate of the heat source unit 18. The conveying unit 30 further includes, for example, a driving motor which rotates the first to fourth flappers F1 to F4. The controller 52 controls switching of a conveying direction of the sheet P by controlling a flapper motor of the conveying unit 30.

Miniaturization of the decoloring device 100 is demanded. To achieve miniaturization, a distance to the first flapper F1 which switches the conveying direction of the sheet P from, for example, the reading unit to the second conveying path 32 or the third conveying path 33 cannot be made longer. However, the distance from the reading unit 16 to the first flapper F1 requires a predetermined length to read the image of the sheet P reliably.

Figure 5:
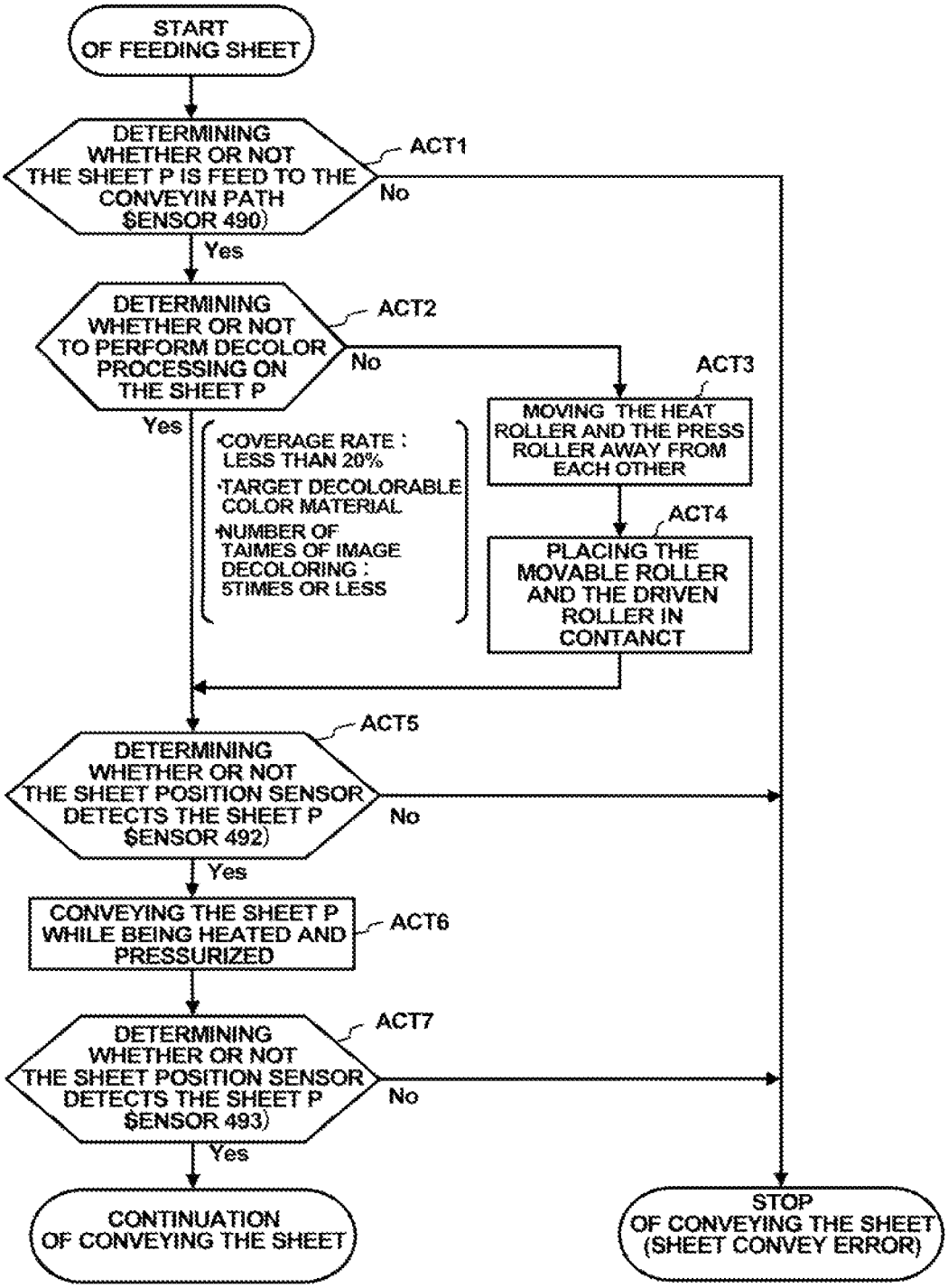
FIG. 5 is a flowchart illustrating an operation of the decoloring device according to the first embodiment.

An operation of the decoloring device 100 for preventing the heat source unit 18 from performing heating processing required for decoloring, on the non-decolor processing target sheet P by mistake will be described with reference to FIGS. 5 to 7. FIG. 5 is a flowchart illustrating the operation of the decoloring device.

The flowchart in FIG. 5 mainly indicates processing executed by the controller 52. The controller 52 controls the first and second decoloring units 18*a* and 18*b* according to the processing indicated by the flowchart in FIG. 5 when the non-decolor processing target sheet P passes through the heat source unit 18. Operations of the first and second decoloring units 18*a* and 18*b* controlled by the controller 52 will be described below with reference to FIG. 3, too.

As illustrated in FIG. 5, after the paper feed tray 11 starts feeding sheets, in ACT 1, the controller 52 determines whether or not the sheet P is fed to the first conveying path 31 from the paper feed tray 11 based on a detection result of the sheet position sensor 490. When the controller 52 determines that the sheet P is not fed to the first conveying path 31 (No in ACT 1), the controller 52 determines that a sheet convey error occurs. When determining that the sheet convey error occurs, the controller 52 causes the conveying unit 30 to stop conveying the sheet P. Meanwhile, when the controller 52 determines that the sheet P is fed to the first conveying path (Yes in ACT 1), processing of the decoloring device 100 moves to ACT 2.

In ACT 2, the controller 52 controls the reading unit 16 to read data of an image of the sheet P before being subjected to decolor processing. The reading unit 16 reads the image on a surface of the sheet P by scanning the surface of the sheet P. The data of the image read by the reading unit 16 includes data of the image printed on the sheet P and various pieces of image formation information of the sheet P. The image formation information includes, for example, a coverage rate of an image printed on the sheet P and count information of image decoloring of the sheet P. The image formation information further includes information of a decoloring temperature of a decolorable color material used for an image printed on the sheet P. In ACT 2, the controller 52 determines whether to perform the decolor processing on the sheet P or not to perform the decolor processing on the sheet P based on the data of the image read by the reading unit 16. Performing the decolor processing on the sheet P means that the sheet P is a decolor target sheet. Meanwhile, not performing the decolor processing means that the sheet P is a non-decolor processing target sheet. Hence, in other words, the controller 52 determines whether or not the sheet P is a non-decolor processing target sheet. More specifically, the controller 52 determines whether or not the sheet P is a non-decolor processing target sheet by determining whether the coverage rate of the image printed on the sheet P is the predetermine coverage rate or more (e.g. 20% or more) or not (e.g. less than 20%).

In ACT 2, the controller 52 further determines whether or not the sheet P is a non-decolor processing target sheet by determining whether the decoloring temperature of a decolorable color material used for the image printed on the sheet P is the decoloring temperature (the setting temperature) or less of the target decolorable color material of the decoloring device 100. In other words, the controller 52 determines whether or not the sheet P is a non-decolor processing target sheet by determining whether or not the decolorable color material of the image printed on the sheet P is the target decolorable color material. In ACT 2, the controller 52 further determines whether or not the sheet P is a non-decolor processing target sheet by determining whether or not the number of times of image decoloring of the sheet P is the number of times which is a threshold or less (e.g. 5 times or less). That is, when the sheet P does not fall under any one of following (a) to (c), the controller 52 determines that the sheet P is a non-decolor processing target sheet. When the controller 52 determines that the sheet P is a non-decolor processing target sheet (No in ACT 2), processing of the decoloring device 100 moves to ACT 3.

(a) The coverage rate is less than 20% (threshold coverage rate).

(b) A decolorable color material is the target decolorable color material.

(c) The number of times of image decoloring is 5 times (threshold count) or less.

In ACT 2, determination criteria of the controller 52 which determines whether or not the sheet P is a non-decolor processing target sheet are the coverage rate of above (a), the type of the decolorable color material of above (b) and the number of times of image decoloring of above (c) as described above. A case where the sheet P does not fall under any one of above (a) to (c) will be more specifically described below.

The case where the sheet P does not fall under above (a) refers to a case where the coverage rate is 20% or more and, more specifically, a state where an image is printed on the nearly entire sheet P. The decolor processing according to the present embodiment is not processing of physically erasing an image. Therefore, a decolorable color material which is made hardly visible by being decolored remains on the sheet P after being subjected to the decolor processing. Hence, when the coverage rate of an image printed on the sheet P is 20% or more, a state of the decolored image is likely to catch user's attention. Therefore, reusing the sheet P after being subjected to the decolor processing is unreasonable. Although the threshold of the coverage rate is 20% in the above example, the threshold of the coverage rate is changeable. More specifically, the control panel 51 receives a change of the coverage rate threshold from the user. The controller 52 stores the threshold of the coverage rate received by the control panel 51 as a new threshold of a coverage rate in the memory 522.

The case where the sheet P does not fall under above (b) refers to a case where a decolorable color material is not the target decolorable color material of the decoloring device 100. A decoloring temperature of a decolorable color material different from the target decolorable color material is the setting temperature (the decoloring temperature of the target decolorable color material) of the decoloring device 100 or less. Hence, there is a concern that a decolorable color material of an image printed on the sheet P melts when heated by the heat source unit 18, and is offset to the first and second heat rollers 18*a*1 and 18*b*1 or the first and second press rollers 18*a*2 and 18*b*2. Therefore, a problem is likely to occur in subsequent decolor processing with respect to the sheets P.

The case where the sheet P does not fall under above (c) refers to a case where the number of times of image decoloring exceeds 5 times. As described above, the decolor processing according to the embodiments is not processing of physically erasing an image, and therefore a decolorable color material which is made hardly visible by being decolored remains on the sheet P after being subjected to decolor processing. Hence, when, for example, decolor processing is performed more than 5 times, a state of a decolored image is likely to catch user's attention. Accordingly, reusing the sheet P after being subjected to decolor processing is unreasonable. The decoloring device 100 includes a printing device such as an ink-jet printer which prints information of the number of times of image decoloring on the sheet P. More specifically, the decoloring device 100 prints a mark as information of the number of times of image decoloring at, for example, an edge of the sheet P using the ink-jet printer every time decolor processing is performed. The ink-jet printer prints a mark using an ink which cannot be decolored. The controller 52 recognizes the number of times of image decoloring of the sheet P by reading the mark using the reading unit 16.

In addition, when the sheet P does not fall under above (a) and when the sheet P does not fall under above (c), when the heat source unit 18 performs decolor processing on the sheet P, an image printed on the sheet P is decolored. By determining that the image of the sheet P is decolored based on data of the image read by the reading unit 16 after the decolor processing, the controller 52 determines that the sheet P is a target double-side reusable sheet or single-side reusable sheet to be stocked on the reuse paper trays 21 and 22. However, when the sheet P does not fall under above (a) and when the sheet P does not fall under above (c), a state of the decolored image is likely to catch user's attention as described above, and reusing the sheet P is unreasonable. Hence, in the present embodiment, both when the sheet P does not fall under above (a) and when the sheet P does not fall under above (c), the controller 52 determines that the sheet P is a non-decolor processing target sheet.

Figure 6:
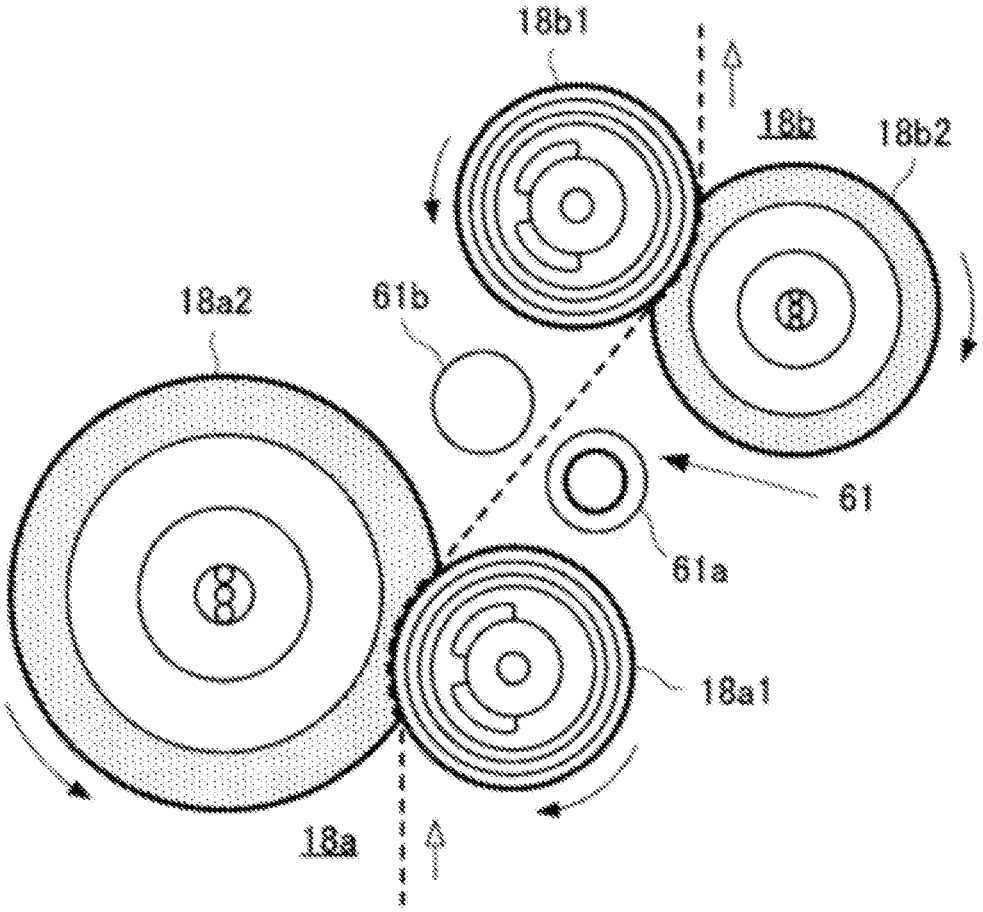
FIG. 6 is a view illustrating an operation of the heat source unit upon decolor processing performed by the decoloring device according to the first embodiment.
Figure 7:
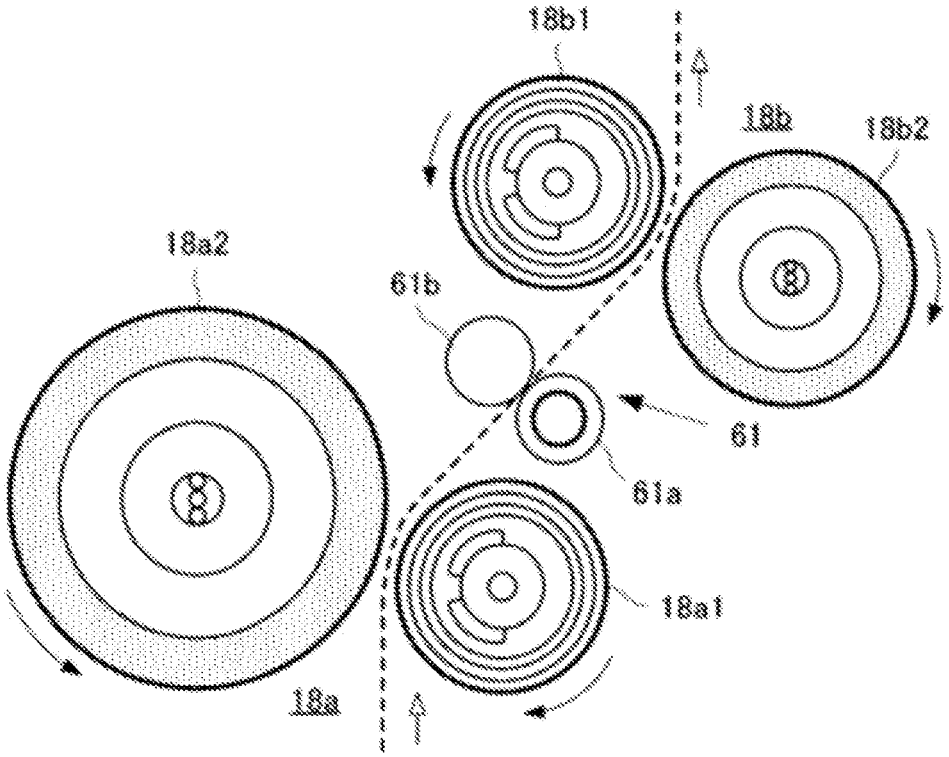
FIG. 7 is a view illustrating an operation of the heat source unit upon non-decolor processing performed by the decoloring device according to the first embodiment.

In ACT 3, the controller 52 moves the first heat roller 18*a*1 and the first press roller 18*a*2, and the second heat roller 18*b*1 and the second press roller 18*b*2 of the first and second decoloring units 18*a* and 18*b* away from each other from states of the first and second decoloring units 18*a* and 18*b* illustrated in FIG. 6. FIG. 6 illustrates a state where the first and second decoloring units 18*a* and 18*b* can perform decolor processing on an image on the sheet P. The first heat rollers 18*a*1 and the first press roller 18*a*2, and the second heat roller 18*b*1 and the second press roller 18*b*2 of the first and second decoloring units 18*a* and 18*b* are in contact. The first heat rollers 18*a*1 and the first press roller 18*a*2, and the second heat roller 18*b*1 and the second press roller 18*b*2 contact with each other to heat the sheet P and perform decolor processing. More specifically, the first decoloring unit 18*a* cause the first press roller 18*a*2 to pressurize the first heat roller 18*a*1 and heat the sheet P which passes through the first heat roller 18*a*1 and the first press roller 18*a*2. The first decoloring unit 18*a* performs decolor processing on an image printed on, for example, the first surface (e.g. top surface) of the sheet by heating this sheet P. The second decoloring unit 18*b* cause the second press roller 18*b*2 to pressurize the second heat roller 18*b*1 and heat the sheet P which passes through the second heat roller 18*b*1 and the second press roller 18*b*2. The second decoloring unit 18*b* performs decolor processing on an image printed on the second surface (e.g. back surface) of the sheet by heating this sheet P.

Hence, in above ACT 3, the controller 52 places the first and second decoloring units 18*a* and 18*b* in a decolor processing disenable state from a decolor processing enable state illustrated in FIG. 6 by moving the first heat roller 18*a*1 and the first press roller 18*a*2, and the second heat roller 18*b*1 and the second press roller 18*b*2 away from each other. When the controller 52 places the first and second decoloring units 18*a* and 18*b* in the decolor processing disenable state, the processing of the decoloring device 100 moves to ACT 4. In ACT 4, the controller 52 places the movable roller 61*a* and the driven roller 61*b* of the sheet conveying roller 61 in contact from a state of the sheet conveying roller 61 illustrated in FIG. 6, and provides a state where the sheet conveying roller 61 can convey the sheet P. The sheet conveying roller 61 pressurizes the driven roller 61*b* toward the movable roller 61*a* in order to place the movable roller 61*a* and the driven roller 61*b* in a sheet convey enable state from a state where the movable roller 61*a* and the driven roller 61*b* in FIG. 6 are moved away from each other (a sheet convey disenable state). FIG. 7 illustrates the heat source unit 18 in a state where the first and second decoloring units 18*a* and 18*b* are in the decolor processing disenable state and in a state where the sheet conveying roller 61 can convey the sheet P. As illustrated in FIG. 7, the first heat roller 18*a*1 and the first press roller 18*a*2, and the second heat roller 18*b*1 and the second press roller 18*b*2 are moved away from each other, and the movable roller 61*a* and the driven roller 61*b* are pressurized and placed in pressure contact. When the controller 52 places the sheet conveying roller 61 in the convey enable state, the processing of the decoloring device 100 moves to ACT 5. Meanwhile, in above ACT 2, when the sheet P falls under all of above (a) to (c) (Yes in ACT 2), the controller 52 determines that the sheet P is a decolor processing target sheet. When the controller 52 determines that the sheet P is a decolor processing target sheet, the controller 52 causes the heat source unit 18 to maintain the decolor processing enable state of the first and second decoloring units 18*a* and 18*b* illustrated in FIG. 6. Further, the processing of the decoloring device 100 moves to ACT 5.

In ACT 5, the controller 52 determines whether or not the sheet position sensor 492 provided at an upstream position of the heat source unit 18 detects the sheet P. When the controller 52 determines that the sheet position sensor 492 does not detect the sheet P (No in ACT 5), the controller 52 determines that a sheet convey error occurs. When determining that the sheet convey error occurs, the controller 52 causes the conveying unit 30 to stop conveying the sheet P. Meanwhile, when the controller 52 determines that the sheet position sensor 492 detects the sheet P (Yes in ACT 5), the processing of the decoloring device 100 moves to ACT 6.

In ACT 6, the controller 52 causes the sheet P to pass through the heat source unit 18. When it is determined in above ACT 2 that the sheet P is a decolor processing target sheet, the heat source unit 18 is in the decolor processing enable state as illustrated in FIG. 6. The heat source unit 18 in the decolor processing enable state causes the first heat roller 18*a*1 and the first press roller 18*a*2, and the second heat roller 18*b*1 and the second press roller 18*b*2 to convey the sheet P while heating and pressurizing the sheet P, perform decolor processing on an image printed on the sheet P and discharge the sheet P to the downstream side of the heat source unit 18. Meanwhile, when it is determined in above ACT 2 that the sheet P is a non-decolor processing target sheet, the heat source unit 18 is in a decolor processing disenable state as illustrated in FIG. 7. The heat source unit 18 in the decolor processing disenable state causes the sheet conveying roller 61 to convey the sheet P, and discharge the sheet P to the downstream side of the heat source unit 18. When the controller 52 causes sheets to pass through the heat source unit 18 as described above, the processing of the decoloring device 100 moves to ACT 7.

In ACT 7, the controller 52 determines whether or not the sheet position sensor 493 disposed at the downstream of the heat source unit 18 detects the sheet P. When the controller 52 determines that the sheet position sensor 493 detects that the sheet P passes (Yes in ACT 7), the controller 52 continues conveying the sheets P. Meanwhile, when the controller 52 determines that the sheet position sensor 493 does not detect the sheet P (No in ACT 7), the controller 52 determines that a sheet convey error occurs. When determining that the sheet convey error occurs, the controller 52 causes the conveying unit 30 to stop conveying the sheets.

As described above, by performing the processing in above ACTs 2, 3 and 4, the decoloring device 100 according to the first embodiment can convey a non-decolor processing target sheet in case where a coverage rate of an image of the sheet is 20% (threshold) or more, from the heat source unit 18 without performing the decolor processing. Further, by performing the processing in above ACTs 2, 3 and 4, the decoloring device 100 can convey a non-decolor processing target sheet in case where the number of times of decolor processing with respect to a sheet exceeds 5 times (threshold), from the heat source unit 18 without performing the decolor processing.

Furthermore, by performing the processing in above ACTs 2, and 4, the decoloring device 100 can convey a non-decolor processing target sheet in case where an image is printed using a decolorable color material different from the decolorable color material which is the decolor processing target of the decoloring device 100, from the heat source unit 18 without performing the decolor processing. Hence, the decoloring device 100 prevents the decolorable color material from offsetting to the first and second heat rollers 18*a*1 and 18*b*1 or the first and second press rollers 18*a*2 and 18*b*2 by being overheated by the heat source unit 18. Consequently, the decoloring device 100 can prevent the decolorable color material from being transferred to and adhered to a next sheet.

As described above, by moving the first heat roller 18*a*1 and the first press roller 18*a*2, and the second heat roller 18*b*1 and the second press roller 18*b*2 from each other, the decoloring device 100 according to the first embodiment lowers a heating temperature of non-decolor processing target sheets to the decoloring temperature or less and causes the non-decolor processing target sheets to pass through the heat source unit 18. Consequently, according to the first embodiment, it is possible to prevent a decolorable color material from being offset to the first and second heat rollers 18*a*1 and 18*b*1, or the first and second press rollers 18*a*2 and 18*b*2 which contact sheets in the heat source unit 18 of the decoloring device 100, and provide stable sheet conveying performance in the heat source unit 18.

Figure 8:
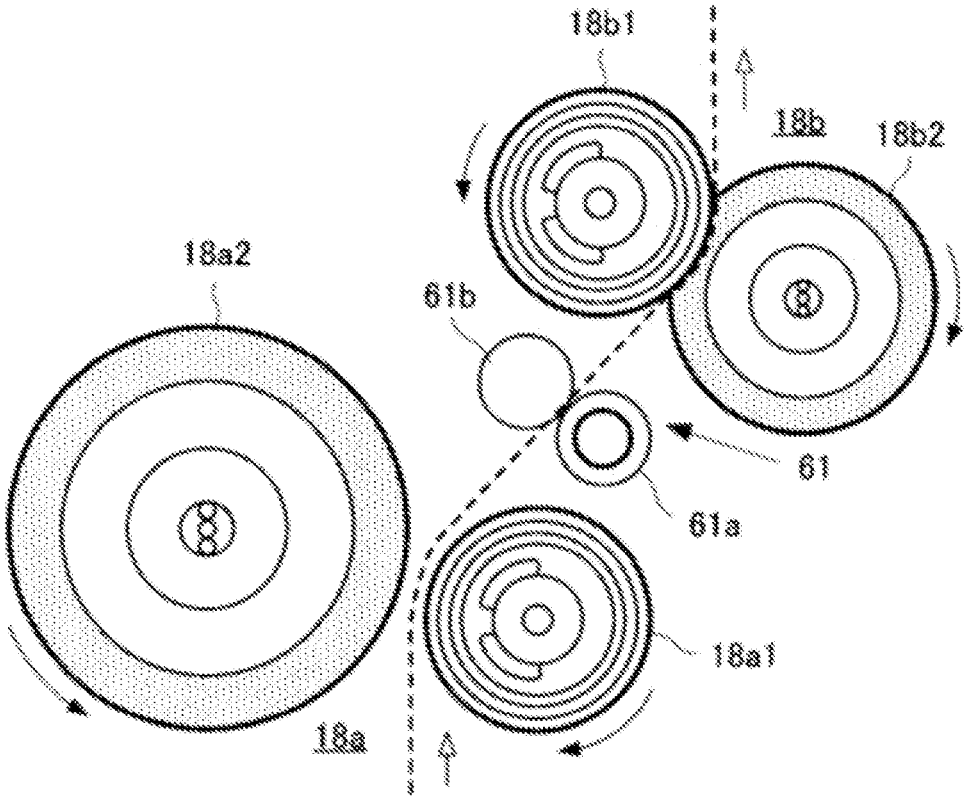
FIG. 8 is a view illustrating an operation of a heat source unit upon non-decolor processing performed by a decoloring device according to a second embodiment.

The second embodiment will be described with reference to FIG. 8. FIG. 8 is a view illustrating an operation of a heat source unit 18 upon non-decolor processing performed by a decoloring device 100 according to the second embodiment.

Similar to the first embodiment, in the decoloring device 100 according to the second embodiment, a heating temperature t2 of a second heat roller 18*b*1 is set lower than a heating temperature t1 of a first heat roller 18*a*1 (t2<t1). Further, the decoloring device 100 determines as a non-decolor processing target sheet a sheet on which an image is printed using a decolorable color material of a lower decoloring temperature than that of a decolorable color material which is the decolor processing target, and does not perform decolor processing. Furthermore, the decoloring device 100 does not perform decolor processing on a non-decolor processing target sheet in case where, for example, a coverage rate of an image is 20% or more, and determines the sheet as a reject target.

In case of a sheet on which an image is printed using a decolorable color material different from the target decolorable color material, a controller 52 moves the first heat roller 18*a*1 and a first press roller 18*a*2 of a first decoloring unit 18*a* away from each other in ACT 3 in FIG. 5. Meanwhile, the controller 52 pressurizes a second press roller 18*b*2 of a second decoloring unit 18*b* toward the second heat roller 18*b*1, and maintains a state where the second press roller 18*b*2 and the second heat roller 18*b*1 are placed in contact.

Hence, as illustrated in FIG. 8, a sheet P passing through the heat source unit 18 in a state where the first heat roller 18*a*1 and the first press roller 18*a*2 move away from each other, and the second heat roller 18*b*1 and the second press roller 18*b*2 contact each other is heated only by the second decoloring unit 18*b*. As described above, the heating temperature t2 of the second heat roller 18*b*1 of the second decoloring unit 18*b* is set lower than the heating temperature t1 of the first heat roller 18*a*1 of the first decoloring unit 18*a*. Further, similar to the first embodiment, the heating temperature t1 is a decoloring temperature of the target decolorable color material. Consequently, even when the sheet P is heated by the second decoloring unit 18*b*, the decoloring device 100 prevents a decolorable color material different from the target decolorable color material, from melting on the sheet P (non-decolorable processing target sheet). Further, even when the decolorable color material of a sheet is the target decolorable color material, when, for example, a coverage rate of an image is 20% or more, the controller 52 moves the first heat roller 18*a*1 and the first press roller 18*a*2 away from each other and maintains a contact state of the second heat roller 18*b*1 and the second press roller 18*b*2 in ACT 3 in FIG. 5 as described above. The first heat roller 18*a*1 and the first press roller 18*a*2 of the first decoloring unit 18*a* of the high heating temperature move away from each other. Consequently, a printed image of a sheet (non-decolor processing sheet) in case where a coverage rate of an image is 20% or more is not decolored even though the sheet P passes through the second decoloring unit 18*b* of the low heating temperature.

As described above, in the decoloring device 100 according to the second embodiment, the second decoloring unit 18*b* is set to a lower heating temperature than that of the first decoloring unit 18*a*. Further, the decoloring device 100 conveys the non-decolor processing target sheet P without causing the sheet P to contact the first heat roller 18*a*1 and the first press roller 18*a*2 of the first decoloring unit 18*a*. Consequently, the non-decolor processing target sheet P is not heated by the first decoloring unit 18*a*. The decoloring device 100 heats the non-decolor processing target sheet P using only the second decoloring unit 18*b*. Therefore, a decolorable color material on the non-decolor processing target sheet P does not reach a decoloring temperature required for decoloring. Even when not performing decolor processing, the decoloring device 100 according to the second embodiment maintains a contact state of the second heat roller 18*b*1 and the second press roller 18*b*2 of the second decoloring unit 18*b* upon decolor processing. Consequently, it is possible to simplify the configuration of the decoloring device 100.

As described above, the decoloring device 100 according to the second embodiment does not require a mechanism which moves the second press roller 18*b*2 with respect to the second heat roller 18*b*1 in the second decoloring unit 18*b*. Consequently, according to the second embodiment, it is possible to simplify the configuration of the heat source unit 18 of the decoloring device 100.

Figure 9:
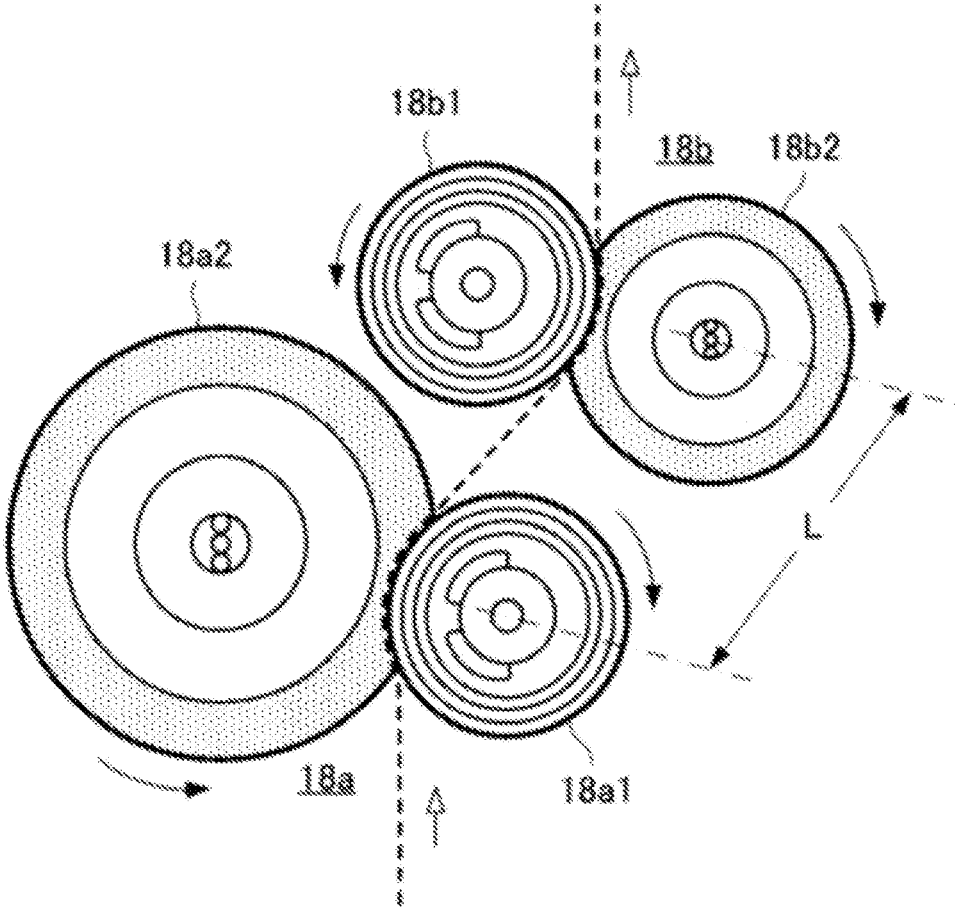
FIG. 9 is a view illustrating an operation of a heat source unit upon decolor processing performed by a decoloring device according to a third embodiment.
Figure 10:
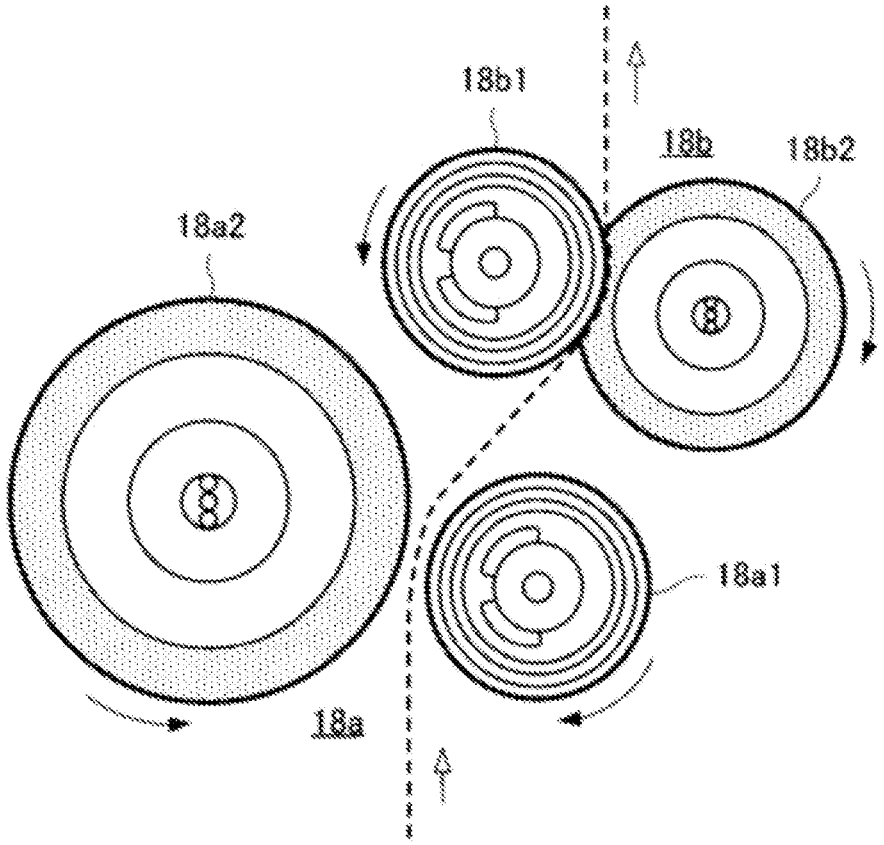
FIG. 10 is a view illustrating an operation of the heat source unit upon non-decolor processing performed by the decoloring device according to the third embodiment.

The third embodiment will be described with reference to FIGS. 9 and 10. FIG. 9 is a view illustrating an operation of a heat source unit 18 upon decolor processing performed by a decoloring device 100 according to the third embodiment. FIG. 10 is a view illustrating an operation of the heat source unit upon non-decolor processing performed by the decoloring device 100 according to the third embodiment.

As illustrated in FIGS. 9 and 10, the decoloring device 100 according to the third embodiment does not include a sheet conveying roller between a first decoloring unit 18*a* and a second decoloring unit 18*b*. Instead of that the sheet conveying path is not provided, the first decoloring unit 18*a* and the second decoloring unit 18*b* are disposed such that an interval L between the first decoloring unit 18*a* and the second decoloring unit 18*b* becomes short. As illustrated in FIG. 9, the interval L is, for example, a distance between a rotary shaft of a first heat roller 18*a*1 and a rotary shaft of a second press roller 18*b*2. Further, similar to the second embodiment, when not performing decolor processing, the decoloring device 100 according to the third embodiment moves the first heat roller 18*a*1 and a first press roller 18*a*2 away from each other, and pressurizes the second press roller 18*b*2 again toward the second heat roller 18*b*1 and maintains a state where the second press roller 18*b*2 and the second heat roller 18*b*1 are placed in contact.

In the decoloring device 100 according to the third embodiment, the interval L between the first decoloring unit 18*a* and the second decoloring unit 18*b* is made short. Consequently, it is possible to convey non-decolor processing target sheets by rotating the second heat roller 18*b*1 and the second press roller 18*b*2. The decoloring device 100 according to the third embodiment does not require the sheet conveying roller, so that it is possible to simplify the entire configuration and contributes to reduction in a weight of the decoloring device 100.

As described above, in the decoloring device 100 according to the third embodiment, the sheet conveying roller provided between the first decoloring unit 18*a* and the second decoloring unit 18*b* in the first and second embodiments can also be used for the second heat roller 18*b*1 and the second press roller 18*b*2 of the second decoloring unit 18*b*. Consequently, according to the third embodiment, it is possible to simplify a configuration and reduce a weight of the decoloring device 100.

The decoloring device according to each of the above embodiments is configured to simultaneously read both surfaces of sheets, yet may be configured to read only a one surface of a sheet. In this case, it is possible to remove a second reading unit 16*b* and the second decoloring unit 18*b* of the heat source unit 18 from the entire configuration of the decoloring device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring device comprising:

a reading unit which reads images on surfaces of a sheet to be conveyed;

a first heat roller which is provided on a first surface side of the sheet, and which heats the sheet from the first surface side of the sheet to perform decolor processing on the image printed on a first surface of the sheet;

a first press roller which is provided to oppose to the first heat roller, and which rotates in contact with the first heat roller by being pressurized in a direction of the first heat roller from a second surface side of the sheet when the decolor processing is performed on the image printed on the first surface of the sheet, and conveys the sheet along with the first heat roller;

a second heat roller which is provided closer to a downstream side in a conveying direction of the sheet than the first press roller and on the second surface side of the sheet, and which heats the sheet from the second surface side of the sheet to perform the decolor processing on the image printed on a second surface of the sheet;

a second press roller which is provided to oppose to the second heat roller, and which rotates in contact with the second heat roller by being pressurized in a direction of the second heat roller from the first surface side of the sheet when the decolor processing is performed on the image printed on the second surface of the sheet, and conveys the sheet along with the second heat roller; and a controller which, when determining that the sheet is a non-decolor processing target sheet based on a reading result of the reading unit, moves the first heat roller and the first press roller away from each other, and moves the second heat roller and the second press roller away from each other.

2. The decoloring device according to claim 1, wherein, when determining that an image is printed on the sheet using a decolorable color material different from a decolorable color material which is a decolor processing target, the controller determines that the sheet is the non-decolor processing target sheet.

3. The decoloring device according to claim 2, wherein a heating temperature of the first heat roller is higher than a heating temperature of the second heat roller.

4. The decoloring device according to claim 3, wherein the heating temperature of the first heat roller is a decoloring temperature of the decolorable color material which is the decolor processing target.

5. The decoloring device according to claim 4, wherein, when determining that the sheet is the non-decolor processing target sheet, the controller maintains a state where the first heat roller and the first press roller move away from each other, and the second heat roller and the press roller contact each other.

6. The decoloring device according to claim 5, further comprising a sheet conveying roller which is disposed closer to a downstream in a sheet conveying direction than the first heat roller and the first press roller and closer to an upstream in the sheet conveying direction than the second press roller and the second heat roller, and which is displaced between a first position at which the sheet cannot be conveyed and a second position which is different from the first position and at which the sheet can be conveyed.

7. The decoloring device according to claim 6, wherein the controller displaces a position of the sheet conveying roller to the first position when determining that the sheet is the decolor processing target sheet based on the reading result of the reading unit, and displaces the position of the sheet conveying roller to the second position when determining that the sheet is the non-decolor processing target sheet.

8. A heat source unit which is used in a decoloring device which decolors images printed on surfaces of a sheet, the heat source unit comprising:

a first heat roller which is provided on a first surface side of the sheet, and which heats the sheet from the first surface side of the sheet to perform decolor processing on the image printed on a first surface of the sheet;

a first press roller which is provided to oppose to the first heat roller, and which rotates in contact with the first heat roller by being pressurized in a direction of the first heat roller from a second surface side of the sheet when the sheet is a decolor processing target sheet, and conveys the sheet along with the first heat roller, and moves away from the first heat roller when the sheet is a non-decolor processing target sheet;

a second heat roller which is provided closer to a downstream side in a conveying direction of the sheet than the first press roller and on the second surface side of the sheet, and which heats the sheet from the second surface side of the sheet to perform the decolor processing on the image printed on a second surface of the sheet; and a second press roller which is provided to oppose to the second heat roller, and which rotates in contact with the second heat roller by being pressurized in a direction of the second heat roller from the first surface side of the sheet when the sheet is the decolor processing target sheet, and conveys the sheet along with the second heat roller.

9. The heat source unit according to claim 8, wherein a heating temperature of the first heat roller is higher than a heating temperature of the second heat roller.

10. The heat source unit according to claim 9, wherein the heating temperature of the first heat roller is a decoloring temperature of the decolorable color material which is the decolor processing target.

11. The heat source unit according to claim 10, wherein the second press roller maintains a contact state with the second heat roller when the sheet is the non-decolor processing target sheet.

12. The heat source according to claim 8, wherein, when the sheet is the non-decolor processing target sheet, the second press roller moves away from the second heat roller.

13. The heat source unit according to claim 12, further comprising a sheet conveying roller which is disposed closer a downstream in a sheet conveying direction than the first heat roller and the first press roller and closer to an upstream in the sheet conveying direction than the second press roller and the second heat roller, and which is displaced between a first position at which the sheet cannot be conveyed and a second position which is different from the first position and at which the sheet can be conveyed.

14. The heat source unit according to claim 13, wherein the sheet conveying roller is displaced to the first position when the sheet is the decolor processing target sheet, and is displaced to the second position when determining that the sheet is the non-decolor processing target sheet.

* * * * *